US011434555B2

(12) United States Patent
Toyoda et al.

(10) Patent No.: US 11,434,555 B2
(45) Date of Patent: Sep. 6, 2022

(54) HOT-ROLLED STEEL SHEET

(71) Applicant: NIPPON STEEL CORPORATION, Tokyo (JP)

(72) Inventors: Takeshi Toyoda, Tokyo (JP); Tetsuya Hirashima, Tokyo (JP); Riki Okamoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/044,693

(22) PCT Filed: Apr. 17, 2019

(86) PCT No.: PCT/JP2019/016395
§ 371 (c)(1),
(2) Date: Oct. 1, 2020

(87) PCT Pub. No.: WO2019/203251
PCT Pub. Date: Oct. 24, 2019

(65) Prior Publication Data

US 2021/0040589 A1 Feb. 11, 2021

(30) Foreign Application Priority Data

Apr. 17, 2018 (JP) ..... JP2018-079352

(51) Int. Cl.

| | |
|---|---|
| ***C22C 38/02*** | (2006.01) |
| ***C22C 38/04*** | (2006.01) |
| ***C22C 38/22*** | (2006.01) |
| ***C22C 38/26*** | (2006.01) |
| ***C22C 38/28*** | (2006.01) |
| ***C22C 38/34*** | (2006.01) |
| ***C21D 8/02*** | (2006.01) |
| ***C21D 9/46*** | (2006.01) |
| ***C22C 38/00*** | (2006.01) |
| ***C22C 38/06*** | (2006.01) |

(52) U.S. Cl.

CPC ..... *C22C 38/34* (2013.01); *C21D 8/0205* (2013.01); *C21D 8/0226* (2013.01); *C21D 8/0236* (2013.01); *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01); *C21D 2211/001* (2013.01)

(58) Field of Classification Search

CPC ..... C22C 38/001; C22C 38/02; C22C 38/04; C21D 2211/001

See application file for complete search history.

(56) References Cited

U.S. PATENT DOCUMENTS

| | | | |
|---|---|---|---|
| 2003/0168137 | A1 | 9/2003 | Chikushi et al. |
| 2014/0227555 | A1 | 8/2014 | Kawata et al. |
| 2019/0169729 | A1 | 6/2019 | Yokoyama et al. |

FOREIGN PATENT DOCUMENTS

| | | | |
|---|---|---|---|
| JP | 9-296252 | A | 11/1997 |
| JP | 11-80893 | A | 3/1999 |
| JP | 3418738 | B2 | 6/2003 |
| JP | 3858146 | B2 | 12/2006 |
| JP | 5068688 | B2 | 11/2012 |
| TW | 201329252 | A1 | 7/2013 |
| WO | WO 2018/011978 | A1 | 1/2018 |

OTHER PUBLICATIONS

"Metallic materials-Tensile testing-Method of test at room temperature", JIS Z 2241, 2011, total 37 pages.
"Method for Charpy pendulum impact test of metallic materials", JIS Z 2242, 2005, total 12 pages.

*Primary Examiner* — Adam Krupicka
(74) *Attorney, Agent, or Firm* — Birch, Stewart, Kolasch & Birch, LLP

(57) ABSTRACT

The hot-rolled steel sheet includes, in % by mass, 0.10% or more and 0.50% or less of C; 0.10% or more and 3.0% or less of Si; 0.5% or more and 3.0% or less of Mn; 0.10% or less of P; 0.010% or less of S; 1.00% or less of Al; 0.010% or less of N; 0% or more and 0.20% or less of Ti; 0% or more and 0.100% or less of Nb; 0% or more and 0.0060% or less of Ca; 0% or more and 0.50% or less of Mo; and 0% or more and 1.00% or less of Cr; with the balance comprising Fe and impurities, and an average grain size of prior austenite in a structure is 0.1 μm or larger and 3.0 μm or smaller, and a sheet crown quantity corresponding to a thickness difference between a width center portion and a portion away, by 10 mm, from a width edge portion in the widthwise direction toward the width center portion is 80 μm or smaller.

1 Claim, No Drawings

HOT-ROLLED STEEL SHEET

TECHNICAL FIELD

The present invention relates to a hot-rolled steel sheet, and more particularly, it relates to a hot-rolled steel sheet having excellent shape and toughness. The present application is based upon and claims the benefit of priority of Japanese Patent Application No. 2018-079352, filed in Japan on Apr. 17, 2018, the entire contents of which are incorporated herein by reference.

BACKGROUND ART

In recent years, for the purposes of improving fuel economy and collision safety of vehicles, a reduction of vehicle body weight utilizing a high-strength and thin steel sheet has been earnestly studied. When the strength of a steel sheet is increased, however, toughness thereof is generally deteriorated. In particular, in a hot-rolled steel sheet applied to a vehicle member, it is significant to assure collision characteristics. Here, it is generally known that the toughness is improved by rolling a steel sheet at a low temperature to impart high cumulative strain in a non-recrystallized austenite region. High cumulative strain and low-temperature rolling increase, however, rolling load, and hence, a resultant steel sheet cannot be made thin and it is difficult to finely control the shape of the steel sheet.

On the contrary, Patent Document 1 proposes a cold-rolled steel sheet having improved toughness, as compared with that of a fine grain structure created by hot rolling, by setting, for increasing a volume fraction of the non-recrystallized austenite region, a rolling reduction and an average strain rate at 860 to 960° C. at which austenite corresponds to an unrecrystallized region in adequate ranges. When the rolling reduction in the non-recrystallized austenite region is increased, however, the strength of the steel sheet is increased, and hence a problem arises in that it is difficult to finely control the shape of the steel sheet.

Patent Document 2 proposes a steel sheet in which coarsening of a crystal grain is suppressed by increasing a finishing temperature and increasing a rolling reduction at 1000° C. or lower to accelerate recrystallization of austenite, and by reducing a time after rolling to cooling. When the rolling reduction is increased, however, it is difficult to predict deformation resistance during rolling, and it is difficult to finely control the shape of the steel sheet due to an increase of rolling force.

Patent Document 3 proposes utilization of a CVC roll, and a method for producing a fine-grained steel sheet having excellent shape by utilizing a roll having a very small diameter. When a CVC roll is used, however, a strain distribution in a widthwise direction is adjusted for stabilizing the shape, and hence, a structure uniform in the widthwise direction cannot be obtained. In addition, when a roll having a very small diameter is used, a contact time with the steel sheet is reduced, and hence a strain rate is increased and anisotropy of mechanical property of steel due to rolling direction is increased.

CITATION LIST

Patent Document

Patent Document 1: Japanese Patent No. 3858146
Patent Document 2: Japanese Patent No. 5068688
Patent Document 3: Japanese Patent No. 3418738

SUMMARY OF THE INVENTION

Problems to be Solved by the Invention

In recent years, for purposes of simultaneously improving safety and fuel economy of vehicles, there are increasing demands to increase the strength of a steel sheet and reduce the thickness. In other words, a product of a thin hot-rolled steel sheet having excellent collision characteristics and toughness is required.

The present invention was achieved in consideration of the above-described problems, and an object is to provide a hot-rolled steel sheet having high strength and excellent toughness as well as having excellent shape.

Means for Solving the Problem

In conventional techniques, for improving the toughness of steel, various methods have been studied for refining a structure by increasing an accumulated rolling reduction in a non-recrystallized austenite region. On the other hand, rolling load is very high in these methods, and hence, the thickness of the steel sheet cannot be reduced. The present inventors earnestly studied a method for forming a fine grain structure of austenite necessary for toughness without increasing the rolling load in rolling stands continuously operated at a high speed as in finish rolling. As a result, it was found that hot deformation resistance is not increased when a temperature and a strain rate are in specific ranges, and thus a fine grain austenite structure can be obtained. Specifically, it was confirmed that when a contact time between a steel sheet and a roll, and an inlet-side temperature of a plate material (steel sheet) in rolling are controlled, the structure of the steel sheet can be refined without increasing the rolling load.

The present invention was devised based on the above-described findings, and the gist of the present invention is as follows:

[1] A hot-rolled steel sheet, containing, in % by mass: 0.10% or more and 0.50% or less of C; 0.10% or more and 3.00% or less of Si; 0.5% or more and 3.0% or less of Mn; 0.10% or less of P; 0.0100% or less of S; 1.00% or less of Al; 0.010% or less of N; 0% or more and 0.20% or less of Ti; 0% or more and 0.100% or less of Nb; 0% or more and 0.0060% or less of Ca; 0% or more and 0.50% or less of Mo; and 0% or more and 1.00% or less of Cr; with the balance comprising Fe and impurities, wherein an average grain size of prior austenite in a structure is 0.1 μm or larger and 3.0 μm or smaller, and a sheet crown quantity corresponding to a thickness difference between a width center portion and a portion away, by 10 mm, from a width edge portion in a widthwise direction toward the width center portion is 80 μm or smaller.

[2] The hot-rolled steel sheet according to [1], containing, in % by mass, one or more of: 0.02% or more and 0.20% or less of Ti; 0.010% or more and 0.100% or less of Nb; 0.0005% or more and 0.0060% or less of Ca; 0.02% or more and 0.50% or less of Mo; and 0.02% or more and 1.00% or less of Cr.

Effects of the Invention

According to the above-described aspects of the present invention, a hot-rolled steel sheet having excellent product shape, high strength and excellent toughness can be provided. According to this hot-rolled steel sheet, absorbed energy is high when deformed at a high speed, good collision characteristics are obtained when used as a vehicle component, the weight of a body of a vehicle or the like can be reduced, the size of a press-formed component can be increased, and thus, fuel economy can be improved and production cost can be reduced.

EMBODIMENTS OF THE INVENTION

For improving the toughness of steel, various methods have been studied for refining a structure by increasing an accumulated rolling reduction in a non-recrystallized austenite region. On the other hand, rolling load is very high in these methods, and hence, the thickness of a steel sheet cannot be reduced. The present inventors earnestly studied a method for forming a fine grain structure of austenite necessary for toughness without increasing the rolling load in rolling stands continuously operated at a high speed as in finish rolling. As a result, it was found that hot deformation resistance is not increased when a temperature and a strain rate are in specific ranges, and thus a fine grain austenite structure can be obtained. Specifically, it was confirmed that when a contact time between a steel sheet and a rolling roll of a final stand, and an inlet-side temperature of the rolling are controlled, the structure of the steel sheet can be refined without increasing the rolling load.

A hot-rolled steel sheet according to one embodiment of the present invention will be described below. The hot-rolled steel sheet of the present embodiment can be obtained by controlling heat transfer and recrystallization during hot finish rolling. A temperature at which a steel sheet enters a final stand of finish rolling, and a contact time between the steel sheet and a rolling roll of the final stand are adjusted, so as to balance temperature reduction through heat removal from a surface of the steel sheet and a recrystallization temperature with each other. Thus, increase of deformation resistance otherwise caused by rolling is suppressed, and a temperature necessary for forming a fine recrystallized structure is assured. By recrystallization caused during hot rolling, increase of rolling load is suppressed, and thus, a sheet crown quantity, that is, a thickness difference between a width center portion and a portion away, by 10 mm, from a width edge portion in a widthwise direction toward the width center portion, can be controlled with high toughness obtained. Specifically, the hot-rolled steel sheet of the present embodiment has a prescribed chemical composition, and has a structure in which an average grain size of a prior austenite grain is 0.1 μm or larger and 3.0 μm or smaller, and the sheet crown quantity, that is, the thickness difference between the width center portion (center portion in the widthwise direction of the steel sheet) and the portion away, by 10 mm, from the width edge portion (edge portion in the widthwise direction of the steel sheet) in the widthwise direction toward the width center portion, is 80 μm or smaller.

Essential components of the present invention will be described in detail below. First, a reason for limitation of the chemical composition (chemical components) of the hot-rolled steel sheet of the present embodiment will be described. It is to be noted that "%" in regard to a component content means "% by mass".

<C: 0.10% or More and 0.50% or Less>

C is a significant element for improving the strength of the steel sheet. For obtaining target strength, it is necessary to set the lower limit of the C content to 0.10% or more. The lower limit of the C content is preferably 0.25% or more. When the C content exceeds 0.50%, however, the toughness of the steel sheet is deteriorated. Therefore, the upper limit of the C content is 0.50% or less.

<Si: 0.10% or More and 3.00% or Less>

Si is an element having an effect of improving the strength of the steel sheet. For obtaining this effect, the lower limit of the Si content is set to 0.10% or more. The lower limit of the Si content is preferably 0.50% or more. On the other hand, when the Si content exceeds 3.00%, the toughness of the steel sheet is deteriorated. Therefore, the upper limit of the Si content is set to 3.00% or less. The upper limit of the Si content is preferably 2.50% or less.

<Mn: 0.5% or More and 3.0% or Less>

Mn is an effective element for improving the strength of the steel sheet by improvement of hardenability and solid solution strengthening. For obtaining this effect, the lower limit of the Mn content is set to 0.5% or more. The lower limit of the Mn content is preferably 1.0% or more. On the other hand, when the Mn content exceeds 3.0%, MnS, which harmfully affects isotropy of toughness, is produced. Therefore, the upper limit of the Mn content is set to 3.0% or less. The upper limit of the Mn content is preferably 2.0% or less.

<P: 0.100% or Less>

P is an impurity, and the P content is preferably lower. In other words, when the P content exceeds 0.100%, workability and weldability are significantly deteriorated, and in addition, fatigue characteristics are also deteriorated. Therefore, the upper limit of the P content is limited to 0.100% or less. The upper limit of the P content is preferably 0.050% or less.

<S: 0.010% or Less>

S is an impurity, and the S content is preferably lower. When the S content exceeds 0.010%, an inclusion such as MnS, which harmfully affects isotropy of toughness, is significantly produced. Therefore, the upper limit of the S content is limited to 0.010% or less. When particularly strict low-temperature toughness is required, the upper limit of the S content is set to preferably 0.006% or less.

<Al: 1.00% or Less>

Al is an element necessary for deoxidation performed in a steelmaking process. When the Al content exceeds 1.00%, however, alumina precipitated in the form of a cluster is produced, and the toughness is deteriorated. Therefore, the upper limit of the Al content is set to 1.00% or less. The upper limit of the Al content is preferably 0.50% or less.

<N: 0.010% or Less>

N is an impurity. When the N content exceeds 0.010%, a coarse Ti nitride is formed at a high temperature, and the toughness of the steel sheet is deteriorated. Accordingly, the upper limit of the N content is set to 0.010% or less. The upper limit of the N content is preferably 0.006% or less.

The hot-rolled steel sheet of the present embodiment contains the above-described chemical components, with the balance comprising Fe and impurities. Here, the term "impurities" means components mixed during industrial production of steel from raw materials, such as ores and scraps, and mixed due to the other factors. Although not indispensable for satisfying required characteristics, however, Ti, Nb, Ca, Mo and Cr may be contained in ranges described below for reducing production variation or further improving the strength. All of Ti, Nb, Ca, Mo and Cr are, however, not indispensable for satisfying the required characteristics, and hence the lower limits of their contents are 0%.

<Ti: 0% or More and 0.20% or Less>

Ti is an effective element for suppressing recrystallization and grain growth of austenite. When Ti is contained in 0.02% or more, an effect of suppressing the recrystallization and the grain growth can be obtained. The lower limit of the Ti content is preferably 0.08% or more. On the other hand, when the Ti content exceeds 0.20%, an inclusion derived from TiN is produced, and hence the toughness of the steel sheet is deteriorated. Therefore, the upper limit of the Ti content is set to 0.20% or less. The upper limit of the Ti content is preferably 0.16% or less.

<Nb: 0% or More and 0.100% or Less>

Nb is an effective element for suppressing the recrystallization and the grain growth of austenite. For obtaining this effect, the lower limit of the Nb content is set to preferably 0.010% or more. On the other hand, when the Nb content exceeds 0.100%, the effect is saturated. Therefore, even when Nb is contained, the upper limit of the Nb content is set to 0.100% or less. A more preferable upper limit of the Nb content is 0.060% or less.

<Ca: 0% or More and 0.0060% or Less>

Ca is an element having an effect of refining the structure of the steel sheet by dispersing a large number of fine oxides in deoxidation of molten steel. In addition, Ca is an element for improving anisotropy of toughness by fixing S contained in the steel in the form of spherical CaS to suppress production of an extended inclusion such as MnS. When these effects are to be obtained, the lower limit of the Ca content is set to preferably 0.0005% or more. On the other hand, when the Ca content exceeds 0.0060%, the effects are saturated. Therefore, even when Ca is contained, the upper limit of the Ca content is set to 0.0060% or less. A more preferable upper limit of the Ca content is 0.0040% or less.

<Mo: 0% or More and 0.50% or Less>

Mo is an effective element for precipitation strengthening of ferrite. When this effect is to be obtained, the Mo content is preferably set to 0.02% or more. A more preferable lower limit of the Mo content is 0.10% or more. On the other hand, when the Mo content is excessive, crack sensitivity of a slab is increased so high that the slab is difficult to handle. Therefore, even when Mo is contained, the upper limit of the Mo content is set to 0.50% or less. A more preferable upper limit of the Mo content is 0.30% or less.

<Cr: 0% or More and 1.00% or Less>

Cr is an effective element for improving the strength of the steel sheet. When this effect is to be obtained, the lower limit of the Cr content is preferably set to 0.02% or more. The lower limit of the Cr content is more preferably 0.10% or more. On the other hand, when the Cr content is excessive, ductility is deteriorated. Therefore, even when Cr is contained, the upper limit of the Cr content is set to 1.00% or less. A more preferable upper limit of the Cr content is 0.80% or less.

Next, the structure of the hot-rolled steel sheet of the present embodiment will be described.

The hot-rolled steel sheet of the present embodiment has a structure in which prior austenite is finely recrystallized. Since the toughness of the hot-rolled steel sheet largely depends on an average grain size of prior austenite, a transformed structure, namely, the steel sheet structure, does not matter. A single phase is preferred in general for improving the toughness, and for example, a single phase of martensite may be employed for high-strength steel, but the present embodiment is not limited to the single phase of martensite. It is to be noted that the hot-rolled steel sheet may contain bainite in the present embodiment. In the present embodiment, an average grain size of the bainite contained in the hot-rolled steel sheet may be 1.0 μm or less.

It is conventionally known that the prior austenite structure is refined for improving the toughness. As means for this purpose, an accumulated rolling reduction in the non-recrystallized austenite region is increased in general. When the rolling reduction is increased, however, rolling load is increased, and a sheet crown quantity, that is, a thickness difference between a width center portion and a portion away, by 10 mm, from a width edge portion in the widthwise direction toward the width center portion, is increased, and hence, problems arise of shape defect and contact failure and surface pressure variation caused in press-forming of the steel sheet. As a result of studies on the relationship between rolling behavior and a structure, an entry temperature of the steel sheet entering a final stand of finish rolling and a contact time between a rolling roll of the final stand and the steel sheet are controlled, so as to balance temperature reduction caused by the rolling roll and a time necessary for recrystallization of austenite with each other, and thus, rolling can be performed without increasing rolling deformation resistance, namely, the rolling load. In this manner, it was found that in the steel sheet in which the prior austenite structure is a fine grain structure, the sheet crown quantity, that is, the thickness difference between the width center portion and the portion away, by 10 mm, from the width edge portion in the widthwise direction toward the width center portion, can be suppressed.

<Structure Including Prior Austenite Having Average Grain Size of 0.1 μm or Larger and 3.0 μm or Smaller>

When the average grain size of prior austenite is smaller than 0.1 μm, the hot-rolled steel sheet loses work hardening characteristics, and hence, cracks easily occur when the steel sheet is coiled or uncoiled after the hot rolling. On the other hand, when the average grain size of prior austenite exceeds 3.0 μm, the steel sheet increased in strength is inferior in low-temperature toughness. A preferable range of the average grain size of prior austenite is 0.5 μm or larger and 2.0 μm or smaller.

In the hot-rolled steel sheet of the present embodiment, the average grain size of prior austenite can be measured by image processing using a photograph of the structure obtained with a scanning electron microscope (SEM).

More specifically, the average grain size of prior austenite is determined as follows.

Assuming that the hot-rolled steel sheet has a width W, a sample is collected in a portion within ¼ W (width) or ¾ W (width) from one edge in the widthwise direction of the hot-rolled steel sheet, such that a cross-section parallel to the rolling direction and vertical to the sheet surface can be an observation surface, and the cross-section is mirror-polished, and the resultant surface is corroded with picric acid to cause a prior austenite grain boundary to appear. Thereafter, a scanning electron microscope (SEM) is used to observe a region disposed at a depth corresponding to ¼ of the thickness from the surface of the steel sheet and having a size of 400 μm in the rolling direction of the steel sheet by 400 μm in the thickness direction.

The thus obtained image is analyzed by an image analyzer to obtain an average grain size of prior austenite. It is to be noted that the average grain size of prior austenite is obtained as an equivalent circle diameter.

Next, the shape of the hot-rolled steel sheet of the present embodiment will be described.

The hot-rolled steel sheet of the present embodiment has excellent shape. In other words, even in a fine-grained steel sheet, which is deteriorated in shape in employing the conventional methods as described above, the sheet crown quantity is small after the hot rolling. When a small sheet crown quantity is attained through the hot rolling, not only can advantages as a hot-rolled steel sheet be obtained but also a steel sheet having excellent shape and toughness can be obtained as a cold steel sheet or a heat-treated steel sheet obtained by further processing the hot-rolled steel sheet.

<Steel Sheet Having Sheet Crown Quantity of 80 μm or Smaller>

When the sheet crown quantity, that is, the thickness difference between the width center portion of the hot-rolled steel sheet and the portion away, by 10 mm, from the width edge portion in the widthwise direction toward the width center portion, obtained in the hot-rolled steel sheet after the hot rolling exceeds 80 μm, a thickness difference in the widthwise direction of the steel sheet is so large that contact failure and surface pressure variation caused in press-forming using the hot-rolled steel sheet as a material are large, and thus, the formability is inferior. The sheet crown quantity is preferably 60 μm or smaller in a large component or when high workability is required. The sheet crown quantity is defined as a difference between an average value of thicknesses measured in 10 positions in the width center portion and an average value of thicknesses measured in 10 arbitrary positions in the portion away, by 10 mm, from the width edge portion in the widthwise direction toward the width center portion.

<Width of Steel Sheet>

The width of the hot-rolled steel sheet of the present embodiment is not especially limited, and is preferably 800 to 1200 mm.

<Thickness of Steel Sheet>

The thickness of the hot-rolled steel sheet of the present embodiment is not especially limited, and is preferably 1.0 to 4.0 mm.

When the hot-rolled steel sheet of the present embodiment has the chemical composition, the structure and the shape described above, the effects can be exhibited. In particular, a production method described below is preferably employed because the hot-rolled steel sheet of the present embodiment can be stably obtained by this method.

Specifically, a method for producing a hot-rolled steel sheet of the present embodiment basically preferably includes the following steps (a) to (d):

(a) A heating step of heating a slab having the above-described component composition at a temperature of 1100° C. or higher and lower than 1350° C.;

(b) a step of finish rolling the slab after the heating step by performing rolling with an entry temperature of a steel sheet in a final stand set to 850° C. or higher and 1050° C. or lower, and with a contact time between the steel sheet and a rolling roll set to 0.005 seconds or longer and 0.020 seconds or shorter;

(c) a cooling step of starting cooling shorter than 0.8 seconds after completing the finish rolling, with an average cooling rate of 100° C./sec or faster from a finish rolling end temperature up to 750° C.; and (d) a coiling step of performing coiling after the cooling step.

In addition, in the method for producing a hot-rolled steel sheet of the present embodiment, any one of the following steps (e) to (h) may be performed after the above-described steps (a) to (d).

(e) A step of pickling and cold rolling the hot-rolled steel sheet produced through the steps (a) to (d);

(f) a step of pickling, cold rolling, annealing, and then skinpass rolling the hot-rolled steel sheet produced through the steps (a) to (d);

(g) a step of pickling, cold rolling, annealing, plating, and then skinpass rolling the hot-rolled steel sheet produced through the steps (a) to (d); and (h) a step of pickling, plating, and then skinpass rolling the hot-rolled steel sheet produced through the steps (a) to (d).

The respective steps will be described below.

<Heating Step>

Before hot rolling, a slab is heated. In heating the slab having the same chemical composition as the hot-rolled steel sheet of the present embodiment obtained by continuous casting or the like, a temperature before the heating is not limited. The heating may be started at 1000° C. as in equipment where casting process is directly connected to hot rolling process, or the slab may be cut and subsequently be heated from room temperature. When the heating temperature is lower than 1100° C., the slab cannot be adequately homogenized. In this case, the strength and the workability of the steel sheet obtained as a result are deteriorated. On the other hand, when the heating temperature exceeds 1350° C., an initial austenite grain size is so large that mixed grain size tends to easily occur in a structure of the steel sheet ultimately obtained. In addition, the production cost is increased, and the productivity is deteriorated. Therefore, the heating temperature is preferably 1100° C. or higher and lower than 1350° C.

<Rolling Step>

In the rolling step, a rough rolling step and a finish rolling step are performed, and the rough rolling step is not especially limited.

On the other hand, in the finish rolling step, it is significant to control the entry temperature of the steel sheet in the final stand, and the contact time between the steel sheet and the roll. The entry temperature of the steel sheet in the final stand needs to be controlled for recrystallization of austenite, and the contact time between the steel sheet and the rolling roll needs to be controlled for balancing the temperature reduction through heat removal and a processing time with each other. In the present embodiment, the entry temperature of the steel sheet in the final stand and the contact time between the rolling roll of the final stand and the steel sheet are controlled to accelerate the recrystallization, and thus, the rolling load can be controlled.

Specifically, the entry temperature of the steel sheet in the final stand is set to 850° C. or higher and 1050° C. or lower. When the temperature is lower than 850° C., the temperature is lowered when the steel sheet comes into contact with the rolling roll, and hence a temperature necessary for the recrystallization cannot be assured. In addition, the rolling load is increased, and hence the shape of the steel sheet becomes inferior. On the other hand, when the temperature exceeds 1050° C., the grain size of the recrystallized austenite becomes coarse, and hence the toughness becomes inferior. For simultaneously attaining a more excellent shape and toughness, the temperature is preferably 900° C. or higher and 960° C. or lower. It is to be noted that the entry temperature of the steel sheet in the final stand corresponds to a surface temperature of the steel sheet immediately before being caught by the rolling roll of the final stand.

Next, the contact time between the rolling roll of the final stand and the steel sheet will be described. The recrystallization behavior during the rolling can be generally clarified based on a relationship between a strain rate and a temperature. In the hot rolling process, however, it is necessary to consider the temperature reduction through the heat removal through the roll and processing heat generation due to high-speed processing. Therefore, even at a strain rate at which the recrystallization appears, the rolling load determining the shape and the deformation resistance are dynamically varied and therefore the contact time between the rolling roll of the final stand and the steel sheet is significant.

In hot rolling equipment generally used for producing steel sheets for vehicles, the contact time between a rolling roll of the final stand and a steel sheet is about 0.001 to 0.003 seconds, and is thus very short. In addition, in order to suppress excessive rolling load when the steel sheet is work hardened during the contact with the rolling roll and hence is not recrystallized, the rolling reduction of the final stand is generally suppressed to be low. When the rolling reduction of the final stand is low, a contact length between the rolling roll of the final stand and the sheet is short, and hence the contact time is short. On the other hand, the contact time between the steel sheet and the rolling roll of the final stand is set to 0.005 seconds or longer and 0.020 seconds or shorter in the present embodiment. When the contact time between the rolling roll of the final stand and the steel sheet is shorter than 0.005 seconds, a time necessary for the recrystallization cannot be assured during the hot rolling, and hence, the prior austenite structure becomes flat and coarse. On the other hand, when the contact time exceeds 0.020 seconds, the heat removal caused through the contact with the roll is increased, and hence, a recrystallization temperature cannot be assured, and in addition, since a temperature difference in the widthwise direction of the steel sheet is increased, the sheet crown quantity is increased. In order to simultaneously attain a more excellent shape and toughness, the contact time between the rolling roll of the final stand and the steel sheet is preferably 0.007 seconds or longer and 0.010 seconds or shorter.

The contact time between the rolling roll of the final stand and the steel sheet can be obtained based on the rolling reduction, the diameter of the rolling roll, the rolling rate, the thickness of the steel sheet on a rolling entry side, and the thickness of the steel sheet on a rolling exit side. The thickness of the steel sheet obtained after the finish rolling and the diameter of the finish rolling roll are not especially limited, but it is preferable that the rolling reduction of the final stand be about 25 to 50%, that the diameter of the finish rolling roll be about 450 to 800 mm, that the strain rate in the final stand be about 12.5 to 100/s, and the thickness of the steel sheet be, when used as a steel sheet for vehicles, 1.0 to 6.0 mm. A sheet-passing speed is set to a rate for satisfying the contact time of the present invention on the basis of the aforementioned production conditions. It is to be noted that the rolling reduction of another rolling roll, excluding the rolling roll of the final stand, is lower than 40% at the maximum in the present embodiment for suppressing the shape deterioration at a stage previous to the finish rolling. The rolling reduction of another rolling roll, excluding the rolling roll of the final stand, is preferably 39% or lower. In addition, a strain rate is usually obtained based on true strain, that is, one of physical quantities.

<Cooling Step>

After completing the finish rolling, in order to maintain the fine recrystallized austenite structure created through the finish rolling, cooling is started shorter than 0.8 seconds after passing through the final stand for the finish rolling. In other words, a time required after passing through the final stand of the finish rolling to a start time of the cooling is set to shorter than 0.8 seconds. The cooling is performed under conditions of an average cooling rate of 100° C./s or faster for cooling from an end temperature of the finish rolling down to 750° C. When the average cooling rate is slower than 100° C./s, the austenite grain grows also during the cooling, and hence the average grain size of the prior austenite grain becomes coarse. A cooling rate at lower than 750° C. minimally affects the average grain size of the prior austenite grain, and hence can be freely selected for obtaining a target hot rolled structure.

The upper limit of the average cooling rate down to 750° C. need not be limited, but the average cooling rate is preferably 600° C./s or slower in consideration of equipment constraints and the like, and in addition, for making uniform a structural distribution in the thickness direction. As for a cooling stop temperature, the cooling is performed down to preferably 550° C. or lower for retaining the prior austenite grain size in a fine-grained state. It is to be noted that an average cooling rate from 750° C. to 550° C. does not affect the average grain size of prior austenite, and hence is not especially limited. The average cooling rate in this temperature region may be appropriately set in accordance with the target strength of the steel sheet to be produced.

In the present embodiment, cooling equipment is installed at a stage following the finish rolling equipment, and the cooling is performed with the steel sheet, having been finish-rolled, caused to pass through the cooling equipment. The cooling equipment is preferably equipment capable of cooling the steel sheet under the above-described cooling conditions. An example of such cooling equipment includes water-cooling equipment using water as a cooling medium.

In addition, in some cooling equipment, no air-cooling section is provided, or one or more air-cooling sections are provided. In the present embodiment, either of such cooling equipment may be used. Even when cooling equipment including an air-cooling section is used, the average cooling rate until reaching 750° C. may be 100° C./sec or faster.

The average cooling rate from the end temperature of the finish rolling down to 750° C. is set to a value obtained by dividing a temperature difference between the end temperature of the finish rolling and 750° C. by a time required from the cooling start time to reach 750° C. The cooling start time is defined as a start time of spraying the cooling medium onto the steel sheet by the cooling equipment. The end temperature of the finish rolling corresponds to the surface temperature of the steel sheet immediately after passing through the final stand.

<Coiling Step>

The hot-rolled steel sheet obtained as a product directly after the hot rolling is coiled preferably at lower than 550° C. for assuring tensile strength of 980 MPa or more.

The hot-rolled steel sheet of the present embodiment may be further subjected to cold rolling or the like. The steps performed after the coiling step will be described below.

<Pickling/Cold Rolling Step>

The hot-rolled steel sheet may be subsequently subjected to a pickling treatment for removing a scale from the surface, and then to the cold rolling step for obtaining a desired steel sheet thickness. Conditions for the pickling treatment are not especially limited. In the present embodiment, there is no need to especially limit conditions for the cold rolling step, and when a rolling reduction in the cold rolling is 30% or higher and 80% or lower, no problem arises in the workability and thickness accuracy in general. When the rolling reduction in the cold rolling exceeds 80%, the steel sheet is difficult to produce due to a crack caused in a width edge portion of the steel sheet, or due to an increase of strength caused by work hardening.

<Annealing Followed by Skinpass Rolling Step>

The cold-rolled steel sheet obtained after the cold rolling may be subjected to an annealing step. When a highest temperature in the annealing exceeds 900° C., the austenite grain size formed through the hot rolling becomes coarse, and hence, the highest heating temperature in the annealing is preferably 900° C. or lower. On the other hand, when the highest heating temperature is lower than 500° C., a long time is necessary for creating a rolled structure by the recrystallization, and hence this heating temperature is not preferable from the viewpoint of productivity. After the annealing, a skinpass rolling step may be further performed for purposes of correcting the shape and adjusting surface roughness. In the skinpass rolling step, a rolling reduction is preferably set to 1.0% or lower so as not to leave a rolled structure.

<Plating Followed by Skinpass Rolling Step>

The hot-rolled steel sheet or the cold-rolled steel sheet may be subjected, for improving corrosion resistance of the surface, to a treatment such as electroplating, hot dipping, or galvannealing treatment. When heat is applied in a plating step, the heat is preferably 900° C. or lower. When it exceeds 900° C., the austenite grain size formed through the hot rolling step becomes coarse. After the plating, a skinpass rolling step may be further performed for purposes of correcting the shape and adjusting the roughness. In the skinpass rolling step, a rolling reduction is preferably set to 1.0% or lower so as not to leave a rolled structure.

EXAMPLES

The hot-rolled steel sheet of the present invention will be specifically described below with reference to examples. It is to be noted that conditions employed in each example are merely exemplified conditions employed for checking the feasibility and the effects of the present invention, and hence the present invention is not limited to the examples described below. The examples can be appropriately modified and practiced within the scope of the gist of the present invention as long as the purposes of the present invention can be achieved without departing from the gist thereof. Accordingly, various conditions can be employed in the present invention, and all of these conditions are encompassed within the technical features of the present invention.

A molten steel having each chemical composition shown in Table 1 is made in a converter, and formed into a slab having a thickness of 230 mm by continuous casting. Thereafter, the slab was heated to a temperature of 1150° C. to 1250° C. to perform rough rolling, and then, subjected to finish rolling, cooling, and coiling under conditions shown in Table 2A or 2B to produce a hot-rolled steel sheet.

In Tables 2A and 2B, a steel grade component used and finish rolling conditions, and a thickness of the steel sheet are shown. In Tables 2A and 2B, "Entry Temperature" refers to a surface temperature of the steel sheet immediately before rolling in a final stand of continuous finish rolling stands, "Contact Time" refers to a time when the steel sheet and a rolling roll are in contact with each other in the final stand, "Cooling Start Time" refers to a time required from completion of the finish rolling by the final stand to start of cooling, "Average Cooling Rate" refers to an average cooling rate from an end temperature of the finish rolling down to 750° C., and "Coiling Temperature" refers to a temperature for performing coiling after completing the cooling. "Thickness" and "Width" refer to dimensions of a product obtained after hot rolling.

TABLE 1

| | Chemical Component (mass %), balance: Fe and impurities | | | | | | | | | | | |
|---|---|---|---|---|---|---|---|---|---|---|---|---|
| Steel Type | C | Si | Mn | P | S | Al | N | Ti | Nb | Ca | Mo | Cr |
| A | 0.12 | 1.20 | 1.2 | 0.015 | 0.008 | 0.01 | 0.003 | — | — | — | — | — |
| B | 0.12 | 1.20 | 1.6 | 0.014 | 0.003 | 0.01 | 0.003 | 0.11 | — | 0.0020 | — | 0.30 |
| C | 0.15 | 0.30 | 0.6 | 0.014 | 0.003 | 0.03 | 0.002 | — | 0.020 | — | 0.30 | — |
| D | 0.15 | 2.00 | 1.8 | 0.015 | 0.001 | 0.03 | 0.002 | — | 0.015 | — | — | — |
| E | 0.20 | 2.00 | 1.3 | 0.015 | 0.002 | 0.30 | 0.004 | 0.02 | — | 0.0030 | — | 0.55 |
| F | 0.20 | 1.80 | 0.7 | 0.014 | 0.003 | 0.30 | 0.004 | 0.12 | 0.035 | — | — | — |
| G | 0.40 | 0.30 | 2.0 | 0.013 | 0.006 | 0.10 | 0.002 | — | 0.010 | — | — | 0.10 |
| H | 0.40 | 1.50 | 2.5 | 0.015 | 0.005 | 0.10 | 0.002 | 0.02 | — | 0.0010 | 0.20 | 0.67 |
| I | 0.05 | 1.30 | 0.8 | 0.015 | 0.003 | 0.01 | 0.002 | — | — | — | — | — |
| J | 0.08 | 0.02 | 2.6 | 0.010 | 0.002 | 0.05 | 0.004 | — | 0.180 | — | — | — |

Underlined values are out of the range of the present invention.

TABLE 2A

| | | Finish Rolling Conditions | | | | | | | | | | | | |
|---|---|---|---|---|---|---|---|---|---|---|---|---|---|---|
| | | Heating | Final Stand | | | | | | | Prior | | Ductile Brittle | | |
| No. | Steel Type | Temperature (° C.) | Entry Temperature (° C.) | Contact Time (s) | Cooling Start Time (s) | Average Cooling Rate (° C./s) | Coiling Temperature (° C.) | Thickness (mm) | Width (mm) | Austenite Average Grain Size (μm) | Tensile Strength (MPa) | Transition Temperature (° C.) | Sheet Crown quantity (μm) | Note |
| 1 | A | 1200 | 1019 | 0.009 | 0.2 | 182 | 521 | 1.2 | 1000 | 1.6 | 1051 | −77 | 47 | Example of Invention |
| 2 | A | 1200 | 972 | 0.006 | 0.1 | 547 | 438 | 3.0 | 1025 | 1.3 | 1241 | −75 | 72 | Example of Invention |
| 3 | A | 1200 | 937 | 0.011 | 0.5 | 279 | 385 | 3.1 | 1070 | 1.2 | 1480 | −80 | 40 | Example of Invention |
| 4 | A | 1250 | 989 | 0.014 | 0.4 | 248 | 341 | 2.3 | 910 | 1.6 | 1575 | −82 | 57 | Example of Invention |
| 5 | A | 1200 | 1037 | 0.015 | 0.6 | 299 | 197 | 1.5 | 910 | 1.9 | 1675 | −51 | 63 | Example of Invention |
| 6 | B | 1250 | 1080 | 0.013 | 0.3 | 138 | 479 | 3.3 | 1120 | 5.3 | 1257 | −12 | 41 | Comparative Example |

TABLE 2A-continued

| No. | Steel Type | Finish Rolling Conditions: Heating Temperature (° C.) | Final Stand: Entry Temperature (° C.) | Final Stand: Contact Time (s) | Cooling Start Time (s) | Average Cooling Rate (° C./s) | Coiling Temperature (° C.) | Thickness (mm) | Width (mm) | Prior Austenite Average Grain Size (μm) | Tensile Strength (MPa) | Ductile Brittle Transition Temperature (° C.) | Sheet Crown quantity (μm) | Note |
|---|---|---|---|---|---|---|---|---|---|---|---|---|---|---|
| 7 | B | 1150 | 947 | 0.019 | 0.5 | 433 | 146 | 2.8 | 1120 | 1.4 | 1554 | −55 | 52 | Example of Invention |
| 8 | B | 1250 | 907 | 0.016 | 0.2 | 296 | 202 | 3.8 | 1135 | 1.1 | 1123 | −87 | 40 | Example of Invention |
| 9 | B | 1200 | 974 | 0.006 | 0.7 | 301 | 345 | 1.6 | 1050 | 1.3 | 1223 | −93 | 43 | Example of Invention |
| 10 | C | 1250 | 858 | 0.019 | 0.3 | 521 | 176 | 2.5 | 1050 | 0.9 | 1556 | −131 | 42 | Example of Invention |
| 11 | C | 1250 | 980 | 0.016 | 0.1 | 210 | 158 | 3.3 | 934 | 1.5 | 1639 | −80 | 49 | Example of Invention |
| 12 | C | 1200 | 1027 | 0.007 | 0.2 | 185 | 542 | 1.7 | 934 | 1.6 | 1002 | −64 | 52 | Example of Invention |
| 13 | C | 1200 | 973 | 0.010 | 0.7 | 380 | 547 | 3.4 | 1050 | 1.4 | 1112 | −84 | 66 | Example of Invention |
| 14 | C | 1150 | 1032 | 0.019 | 0.7 | 532 | 243 | 2.6 | 1050 | 2.0 | 1293 | −69 | 51 | Example of Invention |
| 15 | D | 1200 | 989 | 0.040 | 0.1 | 208 | 162 | 3.2 | 700 | 1.4 | 1467 | −55 | 92 | Comparative Example |
| 16 | D | 1250 | 884 | 0.020 | 0.6 | 131 | 377 | 1.8 | 1040 | 1.0 | 1040 | −86 | 74 | Example of Invention |
| 17 | D | 1200 | 912 | 0.002 | 0.1 | 281 | 493 | 1.0 | 1040 | 4.8 | 982 | −23 | 50 | Comparative Example |
| 18 | D | 1200 | 856 | 0.012 | 0.3 | 406 | 454 | 1.2 | 800 | 0.8 | 1134 | −132 | 67 | Example of Invention |
| 19 | E | 1150 | 930 | 0.007 | 0.6 | 245 | 302 | 2.6 | 800 | 1.1 | 1380 | −97 | 74 | Example of Invention |
| 20 | E | 1250 | 851 | 0.006 | 0.1 | 352 | 542 | 3.9 | 1025 | 0.7 | 1262 | −145 | 75 | Example of Invention |

Underlined values are out of the range of the present invention.

TABLE 2B

| No. | Steel Type | Finish Rolling Conditions: Heating Temperature (° C.) | Final Stand: Entry Temperature (° C.) | Final Stand: Contact Time (s) | Cooling Start Time (s) | Average Cooling Rate (° C./s) | Coiling Temperature (° C.) | Thickness (mm) | Width (mm) | Prior Austenite Average Grain Size (μm) | Tensile Strength (MPa) | Ductile Brittle Transition Temperature (° C.) | Sheet Crown Value (μm) | Note |
|---|---|---|---|---|---|---|---|---|---|---|---|---|---|---|
| 21 | E | 1200 | 963 | 0.017 | 0.2 | 504 | 284 | 1.8 | 840 | 1.5 | 1372 | −88 | 47 | Example of Invention |
| 22 | E | 1200 | 868 | 0.005 | 0.7 | 311 | 293 | 1.4 | 1085 | 0.8 | 1065 | −119 | 48 | Example of Invention |
| 23 | F | 1250 | 1022 | 0.014 | 0.6 | 123 | 352 | 2.8 | 1100 | 1.8 | 1461 | −64 | 68 | Example of Invention |
| 24 | F | 1150 | 830 | 0.015 | 0.9 | 492 | 406 | 2.2 | 1115 | 6.2 | 1053 | −35 | 102 | Comparative Example |
| 25 | F | 1250 | 866 | 0.008 | 0.6 | 511 | 189 | 3.3 | 1045 | 0.8 | 1622 | −121 | 49 | Example of Invention |
| 26 | F | 1200 | 850 | 0.012 | 0.6 | 264 | 248 | 2.8 | 1175 | 0.8 | 1662 | −121 | 63 | Example of Invention |
| 27 | G | 1250 | 973 | 0.014 | 0.3 | 477 | 300 | 3.3 | 1100 | 1.5 | 1520 | −75 | 53 | Example of Invention |
| 28 | G | 1250 | 953 | 0.015 | 2.3 | 360 | 126 | 2.4 | 1100 | 5.6 | 1622 | −32 | 51 | Comparative Example |
| 29 | G | 1200 | 1005 | 0.007 | 0.3 | 293 | 516 | 2.8 | 1110 | 1.5 | 1114 | −81 | 43 | Example of Invention |
| 30 | G | 1200 | 873 | 0.016 | 0.5 | 152 | 264 | 3.4 | 1135 | 0.9 | 1388 | −77 | 40 | Example of Invention |
| 31 | G | 1250 | 948 | 0.019 | 0.2 | 550 | 273 | 1.7 | 1135 | 1.4 | 1645 | −58 | 75 | Example of Invention |
| 32 | H | 1200 | 992 | 0.011 | 0.2 | 40 | 562 | 2.7 | 865 | 6.8 | 952 | −25 | 73 | Comparative Example |
| 33 | I | 1250 | 962 | 0.018 | 0.4 | 489 | 607 | 1.9 | 1050 | 1.5 | 785 | −55 | 61 | Comparative Example |

TABLE 2B-continued

| | | Finish Rolling Conditions | | | | | | | | | | | | |
|---|---|---|---|---|---|---|---|---|---|---|---|---|---|---|
| | | | Final Stand | | | | | | | | | Ductile | | |
| No. | Steel Type | Heating Temperature (° C.) | Entry Temperature (° C.) | Contact Time (s) | Cooling Start Time (s) | Average Cooling Rate (° C./s) | Coiling Temperature (° C.) | Thickness (mm) | Width (mm) | Prior Austenite Average Grain Size (μm) | Tensile Strength (MPa) | Brittle Transition Temperature (° C.) | Sheet Crown Value (μm) | Note |
| 34 | A | 1200 | 1019 | 0.009 | 0.2 | 182 | 621 | 1.2 | 1000 | 1.6 | 1401 | −77 | 47 | Example of Invention |
| 35 | A | 1200 | 1037 | 0.015 | 0.6 | 299 | 497 | 1.5 | 910 | 1.9 | 1827 | −51 | 63 | Example of Invention |
| 36 | B | 1250 | 1080 | 0.013 | 0.3 | 138 | 579 | 3.3 | 1120 | 5.3 | 1570 | −12 | 41 | Comparative Example |
| 37 | C | 1200 | 1027 | 0.007 | 0.2 | 185 | 584 | 1.7 | 934 | 1.6 | 1368 | −64 | 52 | Example of Invention |
| 38 | D | 1200 | 912 | 0.002 | 0.1 | 281 | 693 | 1.0 | 1040 | 4.8 | 1045 | −23 | 50 | Comparative Example |
| 39 | H | 1200 | 992 | 0.011 | 0.2 | 40 | 608 | 2.7 | 865 | 6.8 | 1367 | −25 | 73 | Comparative Example |
| 40 | J | 1040 | 1010 | 0002 | 0.6 | 100 | 400 | 1.6 | 800 | 6.2 | 990 | −21 | 40 | Comparative Example |
| 41 | D | 1250 | 885 | 0.025 | 0.4 | 188 | 309 | 1.5 | 800 | 1.9 | 1314 | −61 | 90 | Comparative Example |

Underlined values are out of the range of the present invention.

In each of the steel sheets thus obtained, the prior austenite structure was corroded in a position corresponding to ¼ of the thickness of the steel sheet, and an image obtained through SEM observation was subjected to image analysis to calculate an average grain size of prior austenite grains. Specifically, in a position corresponding to ¼ W (width) from one edge in the widthwise direction of the steel sheet, assuming that the width of the steel sheet was W, a sample was collected such that a cross-section parallel to the rolling direction and vertical to the surface of the sheet could be an observation surface, the cross-section was minor-polished, and the resultant surface was corroded with picric acid to cause the grain boundary of a prior austenite crystal grain to appear. Thereafter, a scanning electron microscope (SEM) was used to observe a region disposed at a depth corresponding to ¼ of the thickness from the surface of the steel sheet and having a size of 400 μm in the rolling direction of the steel sheet by 400 μm in the thickness direction. The thus obtained image was analyzed with an image analyzer to obtain an average grain size of the prior austenite. It is to be noted that the average grain size of the prior austenite was obtained as an equivalent circle diameter. Similarly, an average grain size of bainite was also measured.

For a tensile test of the steel sheet, a JIS No. 5 test piece was collected along a rolling width direction (C direction) of the steel sheet, and tensile strength TS (MPa) was evaluated in accordance with JIS Z2241:2011. When the tensile strength was 980 MPa or more, the steel sheet was determined as acceptable.

For measuring a ductile brittle transition temperature, the Charpy impact test for a notch in the C direction was performed on a V-notch test piece having a sub-size of 2.5 mm prescribed in JIS Z2242:2005, and a temperature corresponding to an area percent brittle fracture of 50% was defined as the ductile brittle transition temperature. In addition, when the steel sheet had a final thickness smaller than 2.5 mm, the measurement of the steel sheet was performed with the full thickness. When the ductile brittle transition temperature was −50° C. or lower, the steel sheet was determined as acceptable.

As a sheet crown quantity, a thickness difference between a width center portion of the steel sheet and a portion away, by 10 mm, from a width edge portion in the widthwise direction toward the width center portion was calculated. Specifically, the sheet crown quantity was obtained based on a difference between an average value of thicknesses of the width center portion measured in 10 arbitrary positions in the width center portion and an average value of thicknesses measured in 10 arbitrary positions in the portion away, by 10 mm, from the width edge portion in the widthwise direction toward the width center portion.

As shown in Tables 2A and 2B, in examples of the present invention, the tensile strength was 980 MPa or more, the ductile brittle transition temperature was −50° C. or lower, and thus, the strength and the toughness were excellent. In addition, the sheet crown quantity was small, and the production shape was good. All the examples of the present invention contained bainite, and the average grain size of the bainite was 1.0 μm or smaller.

On the contrary, in Test No. 6, the entry temperature was high, the recrystallized grain of prior austenite was coarse, and the toughness was inferior.

In Test No. 15, the contact time was long, the heat removal through the contact with the roll was large, a temperature difference in the widthwise direction of the steel sheet was large, and a difference in the deformation resistance in the widthwise direction was large, and hence the sheet crown quantity exceeded 80 μm.

In Test No. 17, the contact time was short, and a time for the recrystallization was not sufficient during the hot rolling, and hence the prior austenite grain size was coarse and the toughness was inferior.

In Test No. 24, the entry temperature was low, and hence a temperature necessary for the recrystallization could not be assured, the prior austenite grain was coarse and the rolling load was high, and hence the sheet crown quantity was large. Therefore, the toughness and the sheet crown quantity were inferior.

In Test No. 28, the time after passing through the final stand to the start of the cooling was 0.8 seconds or longer, and a prior austenite grain thus grew, and hence the average grain size was coarse and the toughness was inferior.

In Test No. 32, the cooling rate was slower than 100° C./sec, and a grain thus grew after the recrystallization, and hence the prior austenite grain was coarse and the toughness was inferior.

In Test No. 33, the amount of carbon in the steel was so small that the tensile strength was inferior.

In Test No. 36, the entry temperature was high, the recrystallized grain of prior austenite was coarse, and the toughness was inferior.

In Test No. 38, the contact time was short, and hence a time for the recrystallization was not sufficient during the hot rolling, and hence the prior austenite grain size was coarse and the toughness was inferior.

In Test No. 39, the cooling rate was slower than 100° C./sec, and a grain thus grew after the recrystallization, and hence the prior austenite grain was coarse and the toughness was inferior.

In Test No. 40, the heating temperature was low, and in addition, the contact time between the rolling roll and the steel sheet was short, and hence a time for the recrystallization was not sufficient during the hot rolling, and hence a prior austenite grain grew and the toughness was inferior. In addition, an average grain size of bainite in Test No. 40 was 1.3 μm.

In Test No. 41, the contact time was long, the heat removal through the contact with the roll was large, a temperature difference in the widthwise direction of the steel sheet was large, and a difference in the deformation resistance in the widthwise direction was large, and hence the sheet crown quantity exceeded 80 μm.

INDUSTRIAL APPLICABILITY

According to the present invention, a hot-rolled steel sheet having excellent shape, high absorbed energy when deformed at a high speed, excellent collision characteristics when used as a vehicle component, and excellent toughness can be provided. When this hot-rolled steel sheet is used, since the shape of the steel sheet is good, press-formability and press-stability are excellent, components can be integrally formed and the machining process can be shortened, and a resultant vehicle has excellent collision characteristics, a smaller weight, and improved fuel economy. Therefore, the present invention has a high industrial value.

What is claimed is:

1. A hot-rolled steel sheet consisting of, in % by mass:

0.10% or more and 0.50% or less of C;
0.10% or more and 3.00% or less of Si;
0.5% or more and 3.0% or less of Mn;
0.100% or less of P;
0.010% or less of S;
1.00% or less of Al;
0.010% or less of N;
0% or more and 0.20% or less of Ti;
0% or more and 0.100% or less of Nb;
0% or more and 0.0060% or less of Ca;
0% or more and 0.50% or less of Mo; and
0% or more and 1.00% or less of Cr;

with the balance comprising Fe and impurities, wherein an average grain size of prior austenite recrystallized during hot-rolling in a structure is 0.1 μm or larger and 3.0 μm or smaller, and a sheet crown quantity corresponding to a thickness difference between a width center portion and a portion away, by 10 mm, from a width edge portion in a widthwise direction toward the width center portion is 80 μm or smaller.

* * * * *